US007054588B2

(12) United States Patent
Wu et al.

(10) Patent No.: US 7,054,588 B2
(45) Date of Patent: May 30, 2006

(54) IMAGE PRODUCTION SYSTEM WITH RELEASE AGENT SYSTEM AND ASSOCIATED METHOD OF CONTROLLING RELEASE AGENT TRANSFER

(75) Inventors: Fangsheng Wu, Rochester, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 207 days.

(21) Appl. No.: 10/645,394

(22) Filed: Aug. 21, 2003

(65) Prior Publication Data

US 2004/0101333 A1 May 27, 2004

Related U.S. Application Data

(60) Provisional application No. 60/427,996, filed on Nov. 21, 2002.

(51) Int. Cl.
*G03G 15/20* (2006.01)

(52) U.S. Cl. ..... 399/325

(58) Field of Classification Search ..... 399/324, 399/325, 67, 320; 118/60, DIG. 1
See application file for complete search history.

(56) References Cited

U.S. PATENT DOCUMENTS 4,426,953 A * 1/1984 Kromm et al. ..... 118/60
5,045,890 A * 9/1991 DeBolt et al. ..... 399/325
5,200,786 A * 4/1993 Fromm et al. ..... 399/325
5,285,245 A 2/1994 Goto et al. ..... 355/284
5,576,821 A * 11/1996 Rasch et al. ..... 399/325
5,634,184 A * 5/1997 Dalal et al. ..... 399/325
5,729,812 A * 3/1998 Moser ..... 399/329
5,835,833 A 11/1998 Dalal et al. ..... 399/325
5,875,381 A * 2/1999 Moser ..... 399/324
5,890,047 A * 3/1999 Moser ..... 399/329
5,987,293 A * 11/1999 Diels ..... 399/325
6,075,966 A 6/2000 Davis et al. ..... 399/325
6,091,924 A * 7/2000 Bhattacharya ..... 399/325
6,112,045 A 8/2000 Hauman ..... 399/325
6,360,072 B1 * 3/2002 Costrop et al. ..... 399/325
6,408,159 B1 * 6/2002 Ishizuka et al. ..... 118/DIG. 1
2002/0044805 A1 * 4/2002 Hasegawa ..... 399/325
2003/0215270 A1 * 11/2003 Yamada ..... 399/325
2004/0105707 A1 * 6/2004 Schlien ..... 399/325

* cited by examiner

*Primary Examiner*—G. Bradley Bennett

(57) ABSTRACT

A fuser release agent dispensing system for a rotatable fuser, including a transfer stage and a metering stage. The transfer stage includes a first roller having a surface rotatable about a fixed axis, and a second roller positionable for contacting the first roller. The second roller is positionable against the fuser roller. The first roller is driven by the fuser roller and it, in turn, drives the second roller. The metering stage includes a sump for supplying release agent, a metering roller with a surface for removing release agent from the sump and a translational assembly configured to move the metering roller surface into and out of contact with the first roller surface. The amount of fluid release agent transferred from a sump to a fuser is controlled in response to a change in one or more image reproduction parameters.

15 Claims, 5 Drawing Sheets

IMAGE PRODUCTION SYSTEM WITH RELEASE AGENT SYSTEM AND ASSOCIATED METHOD OF CONTROLLING RELEASE AGENT TRANSFER

This appln. claims the benefit of prov. appln. 60/427,996 filed on Nov. 21, 2002.

FIELD OF THE INVENTION

The present invention relates to systems for electrostatic printing and, more specifically, to systems and methods providing selective control of release agents to fuser rollers.

BACKGROUND OF THE INVENTION

In the process of electrophotography an image is recorded in the form of an electrostatic latent image on a photosensitive member. The latent image is subsequently rendered optically visible by application of electroscopic marking particles commonly referred to as toner. The toner-based image is transferred to another substrate such as a sheet of paper and affixed thereto. The toner is commonly fixed or fused to the substrate by a combination of heat and pressure. That is, the temperature of the toner is elevated to a point at which elements of the toner coalesce and become tacky such that these elements flow into fiber or pores or otherwise along the substrate surface. Thereafter, as the toner material cools, the toner material solidifies and bonds firmly to the support member.

Conventionally, a common approach to heat and pressure fusing of electrostatic images on a support substrate such as paper involves passing the substrate with the toner images formed thereon between a pair of roller members at least one of which is heated. The heated member is commonly referred to as the fuser roller.

In the past, toner particles have been offset, i.e., transferred to the fuser roller for a variety of reasons, including insufficient heating, surface imperfections on the fuser roller or insufficient electrostatic forces to hold the toner particles against the substrate. Several solutions have been provided to address this problem. Typically, the surface of the fuser roller is coated with a low-surface energy release agent, such as silicone oil. Such release agents are transferred to the fuser roller from an oil sump via a roller assembly wherein one or more roller surfaces are wet with the agent and, through rolling action, the agent is transferred to the fuser roller. See, for example, U.S. Pat. Nos. 6,075,966 and 6,112,045 each now incorporated herein by reference. It is desirable that such assemblies, referred to as oilers, pass controlled and consistent amounts of oil, i.e., release agent, to the fuser roller.

A prior art oiler configuration is shown in FIG. 1 wherein an oil sump 2 includes a metering roller 4 positioned against a wick 6 to take up silicone-based oil (release agent fluid) along a surface 8 of the metering roller 4 from the sump 2. A metering blade 10 supported by a holder 12 is positioned against the metering roller 4 to limit the amount of oil carried along the surface 8 to the surface 14 of a donor roller 16. Transfer of oil through the wick is believed to limit streaking. The donor roller 16 is in frictional contact with the fuser roller 18 as well as the metering roller 4 such that movement of the fuser roller 18 drives rotation of the metering roller 4 to transfer the release agent from the sump to the surface of the fuser roller.

Despite numerous modifications and improvements made to such oiler systems, undesirable characteristics persist. For paper substrates it is important to transfer a uniform and consistent amount of release agent to the fuser roller surface. However, in multisheet printing operations it is common for the release agent transfer rate to begin at three to four times the desired rate and to substantially decline after the first ten to twenty sheets are processed. This surge of release agent may be attributed to several factors.

Residual fluid is often left on the fuser roller surface from prior duplication runs. The amount of such fluid depends in part on the split ratio between rollers 4, 16 and 18. With a simple 50 percent split in fluid volume between rollers, the residual release agent fluid on the fuser roller can rise to four times the desired steady state rate.

In addition, if the oiler remains idle for a significant time interval, e.g., five to ten minutes, some fluid will migrate to the metering blade 10 by capillary forces. With this accumulation in place, when the oiler is next engaged, a surge of fluid, e.g., tens of mgs, will be transferred to the fuser roller and ultimately to the substrate.

Another factor affecting the volume of release agent transferred is the oil viscosity which, varies substantially with temperature fluctuations. Thus, in systems which require thermal fusing of the toner, temperature variations are to be expected and such variations will have an influence on viscosity. Predictably, the temperature of the metering roller is relatively low at the beginning of a run and increases as each sheet is processed during the run. While it is somewhat difficult to quantify the viscosity variation, limited tests indicate that normal heating can alter the viscosity to the point where, if other variables remain constant, the fluid transfer rate may at least double.

One other variable affecting the oil transfer rate is the uncontrollable variation in roller speeds, particularly the speed of the metering roller which is driven by the donor roller. When there is too much oil on the adjoining surfaces, substantial slippage occurs which, in turn, results in slower movement of the metering roller. As the metering roller speed decreases, the amount of oil transferred to the donor roller also decreases. It should also be noted that, when there is a speed differential between the rollers, a drag force may persist which force can accelerate wear of the fuser roller.

The aforementioned variables are believed to result in non-uniform and unpredictable oil transfer rates. Further, although the oil transfer rates may be established through design, such rates are fixed, i.e., not adjustable, for individual designs.

Another difficulty with existing systems relates to required blade tolerances. That is, if the blade is not made with sufficient precision, defects along the blade edge result in non-uniform oil transfers across the rollers. Such transfers are known to create image streaks.

It is desirable to provide improved methods and improved systems which control the amounts and uniformity of a release agent. Such improvements would result in more satisfactory image reproduction and lower maintenance of associated equipment. It is also desirable to adjustably control the rate of fluid transfer from the sump to the fuser roller. In conventional designs, one or more parameters may be adjusted to control the transfer rate, but because these are fixed for each design the transfer rate is not user adjustable.

SUMMARY OF THE INVENTION

The invention provides release agent fluid dispensing systems and methods of dispensing such oils in image reproduction systems. According to one embodiment, a fluid dispensing system includes a rotating fuser, a first (transfer)

stage and a second (metering) stage. The first (transfer) stage includes a first roller having a surface rotating about a fixed axis and a second roller positioned for contact with the first roller. In one form of this embodiment the second roller includes an axis rotatable about the axis of the first roller for selective engagement with the fuser roller. The second roller is also positioned against the fuser roller and imparts the rotation motion of the fuser roller to the first roller. The second (metering) stage includes a sump for supplying the release agent metering roller with a surface for removing release agent from the sump and a translational assembly configured to move the metering roller surface into and out of contact with the first roller surface.

The metering roller is coupled to a drive system that turns the metering roller. The metering roller may turn constantly or turn only when engaged with the first roller. The second (metering) stage includes a metering surface in contact with the metering roller to control the amount of fluid transferred from the sump by the metering roller. The metering surface may be either a fourth metering roller or a metering plate.

In the invention the first (transfer) stage uniformly distributes the controlled amount across the surface of the fuser roller. The first (transfer) stage has two soft rollers. The soft rollers form a nip that uniformly distributes release agent to the fuser surface. The metering stage may have a pair of hard rollers or a hard metering roller and soft fourth roller. The second (metering) stage rollers are at least partially immersed in a reservoir of release agent fluid. The second (metering) stage withdraws an amount of fluid proportional to the speed of the metering roller. The metering roller in the second (metering) stage contacts a soft first roller in the first (transfer) stage and transfers a controlled amount of release agent to the soft first roller; the other soft roller contacts the fuser roller. The transferred release agent enters the nip of the soft rollers in the first (transfer) stage where the fluid is uniformly distributed across the nip of the soft rollers and thus across the surface of the fuser roller.

In another embodiment, the second (metering) stage has a reservoir, a hard metering roller, and a metering plate. It has a relatively hard surface but may be made of elastomeric material. The metering roller is driven at a speed selected to control the amount of release agent withdrawn from the reservoir. The speed of the metering roller determines the amount of release agent withdrawn from the reservoir.

In one embodiment of the invention, the fuser roller and the first (transfer) stage are on one frame and the second (metering) stage is on another frame with the fuser roller. In the first (transfer) stage, the first roller is fixed with respect to the fuser roller and the second transfer roller may move about the surface of the first roller to engage or disengage with the surface of the fuser roller. The second (metering) stage moves vertically to engage or disengage the metering roller of the second (metering) stage with the first soft transfer roller of the first (transfer) stage.

In another embodiment, the two stages are mounted together on their own frame that translates with respect to the fuser roller to engage and disengage the second roller with the surface of the fuser roller. In that embodiment, the release agent management system is independent of the fuser roller and may be accessed, maintained, and replaced without disturbing the fuser roller.

The invention allows the metering roller in the second (metering) stage to turn at a speed different from the transfer rollers in the first (transfer) stage. This difference in speed is referred to as slip. The metering roller is usually a hard or metallic surface roller and the transfer rollers have soft or elastomeric surfaces. The hard metering roller can slip in its engagement with the first, soft transfer roller. This allows the system to deliver a controlled amount of release agent to the first (transfer) stage. In the prior art, the speed of the fuser roller effectively controlled the speed of the single stage release agent rollers and thus controlled the amount of release agent. In the invention, the separate speed control of the second (metering) stage controls the amount of release agent.

In still another method, useful in conjunction with a fuser release agent system that transfers a variable amount of the release agent from a sump to the fuser, the amount of release agent transferred from the sump to the fuser is controlled in response to signals indicative of a change in one or more image reproduction parameters. An associated image reproduction system is formed with a fuser release agent subsystem and a processor subsystem. The fuser release agent subsystem includes a sump for containing a release fluid for transfer to the fuser and a stage configured to transfer a variable amount of release fluid from the sump to the fuser. The processor subsystem varies the amount of fluid transferred from the sump to the fuser in response to signals indicative of a change in one or more image reproduction parameters.

The invention, and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

Figure 1:
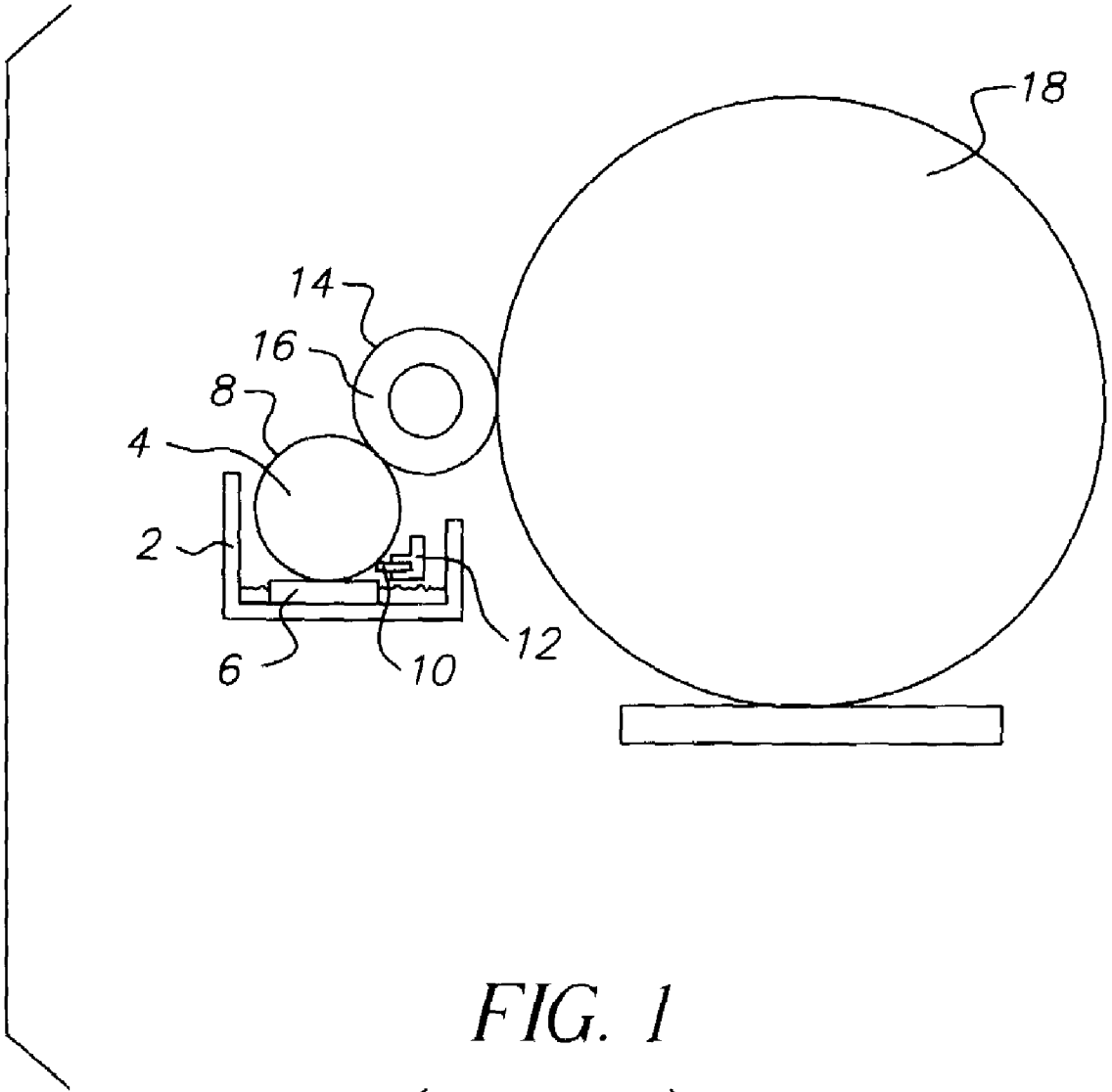
FIG. 1 (PRIOR ART)
FIG. 1 illustrates a prior art oiler.

In accord with common practice the various illustrated features in the drawings are not to scale and may be drawn to emphasize specific features relevant to the invention. Moreover, the sizes of features may depart substantially from the scale with which these are shown. Reference characters denote like elements throughout the figures and the text.

DETAILED DESCRIPTION OF THE INVENTION

Figure 2:
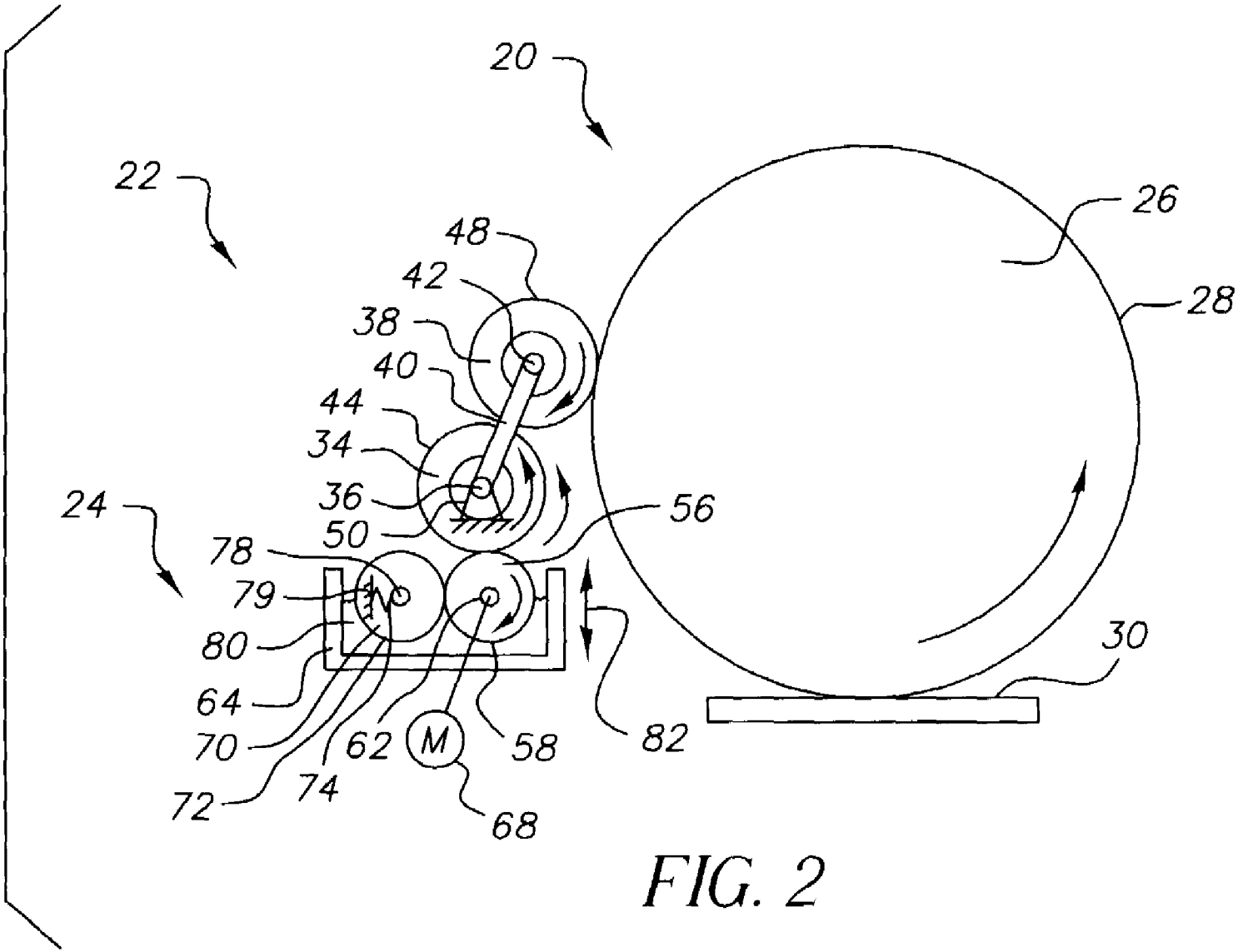
FIG. 2 illustrates a release agent system according to the invention.

FIG. 2 illustrates a release agent system 20 according to the invention. The system 20 has a first (transfer) stage 22, a second (metering) stage 24 and a fuser roller 26 having a surface 28. A toner image bearing substrate 30, which in this example is a sheet of paper (but may be other forms of media), comes in contact with the surface 28 of the fuser roller 26 by any of several well-known mechanisms. Of course, the fuser roller 26 could alternatively be a belt or any other suitable device for fixing the toner image to the substrate. The first (transfer) stage 22 has two soft transfer rollers 34, 38, with elastomeric surfaces. The first transfer roller 34 is mounted for rotation about an axis 36, which axis is held in a fixed relation by support 50 with respect to the fuser roller 26. The second transfer roller 38 is mounted for rotation about an axis 42. The second transfer roller 38 is also coupled for movement about the axis 36 of the first transfer roller 34 50 that the surface 44 of the first roller 34 contacts the surface 48 of the second transfer roller 38 with a pre-selectable force. The coupling is accomplished through a link 40 extending from the first roller axis 36 to the rotational axis 42 of the second roller 38. With the second transfer roller 38 rotationally translatable about the first roller axis 36, it is possible to selectively engage the surface 48 of the second transfer roller 38 against the fuser roller 26 for rotational contact with the surface 28 of the fuser roller.

The second (metering) stage 24 has two hard rollers 56 and 70 that preferably have metal surfaces. Metering roller 56 has a surface 58 and turns about an axis 62 in a sump 64. The metering roller 56 is connected to a drive motor 68 for selective rotation independent of rotation by the fuser roller 26. The other roller 70 has a metering surface 72 and is positioned in the sump 64 about a translatable axis 78. Positioning of the roller metering surface 72 against the metering roller surface 58 is effected with movement of the axis 78 and roller 70 according to the force of a spring 74 (schematically illustrated in FIG. 2) affixed at one end to the axis 78 and affixed at an opposing end to a bearing plate 79. The force of the spring 74 may be increased or decreased to vary the contact pressure between the roller surfaces 58 and 72.

Preferably, the surfaces 58 and 72 of the second (metering) stage rollers 56 and 70 are hard and smooth, e.g., metallic, to facilitate relative motion between roller 34 and roller 56 with a low level of friction and to assure a stable nip between the rollers 70 and 56. That stable nip provides consistency in the amount of release agent delivered to the first (transfer) stage 22. With the force between the rollers 56 and 70 maintained at a desired level, the speed of these two rollers will control the amount of the release agent for transfer to the first (transfer) stage 22.

In operation, the sump 64 is supplied with release agent 80 to a sufficient level that a substantial portion of the metering roller surface 58 is immersed in the release agent. In this example, with the roller 70 positioned to the left of the metering roller 56, i.e., in the cross sectional view of FIG. 2, the metering roller 56 rotates with a clockwise motion such that release agent carried along the surface 58 comes into contact with the surface 72 before reaching a position farthest above the sump release agent level. The force of the spring 74 is adjusted to assure that the amount of release agent moving along the surface 58, after contact with the metering surface 72, is controlled to limit release agent transfer to the surface 44 of the first (transfer) stage roller 34.

The second (metering) stage 24 is positioned for movement along a translatable axis, in the direction indicated by arrows 82, to selectively engage the surface 58 of metering roller 56 against the surface 44 of the transfer roller 34. The mechanism to raise and lower second stage 24 is any suitable conventional device, such as, for example, a lead screw driven by a motor. Advantageously, with the rotation of the metering roller 56 being driven by the motor 68, there is no need to provide a forceful contact between the surface 44 and metering surface 58. In fact, according to the invention, the contact forces between the surfaces 44 and 58 are substantially less than what is required to prevent slippage between the surfaces. There should be sufficient contact to assure desired transfer of release agent from the surface 58 to the surface 44 as the roller 34 rotates in a counter clockwise direction. As such, rollers 34 and 56 are allowed to slip with respect to each other.

Preferably, the drive motor 68 continuously rotates the metering roller 56, at least from a time immediately before the second (metering) stage 24 is moved along the translatable axis in the direction of arrows 82 to engage the metering roller surface 58 against the roller transfer surface 44. Since the contact between the surfaces 44 and 58 is relatively light, relative motion between these roller surfaces is allowable, and according to the invention, is desirable. That is, the relative speed of the roller surface 58 to the roller surface 44 can be modified according to the speed of the drive motor 68 to adjust the release agent transfer rate between roller 56 and roller 34.

Because the system 20 does not require a blade for limiting release agent transfer, problems associated with such blades are eliminated. In addition, when the second (metering) stage 24 is disengaged from the first (transfer) stage 22, e.g., by movement along the translatable axis, the drive motor 68 continues to rotate the metering roller 56 thereby reducing the magnitude of release agent surges. To further stabilize the transfer rate, a heating element (not shown) can be coupled to the sump 64 to assure that the fluid is always at a constant temperature and consistent viscosity.

Figure 3:
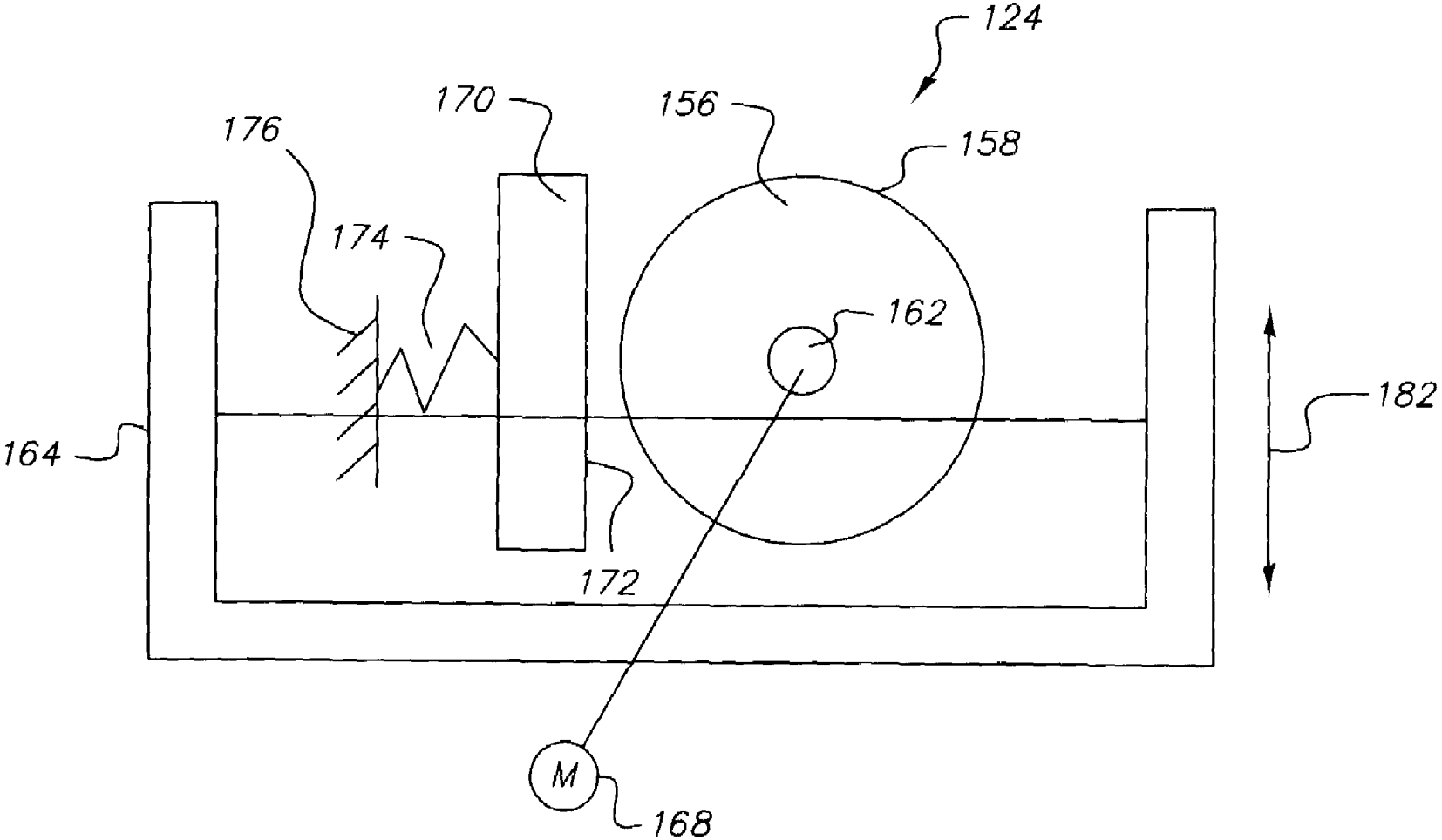
FIG. 3 illustrates a stage of an oiler system according to an alternate embodiment of the invention.

According to another embodiment of the invention, an alternate metering stage 124, illustrated in FIG. 3, includes a hard surface metering roller 156 having a metering surface 158. The roller 156 is rotatable about an axis 162 to move the metering surface 158 in a sump 164. The metering roller 156 is connected to a drive motor 168 for selective rotation independent of rotation by the fuser roller 26 (not shown in FIG. 3). A metering plate 170 has a metering surface 172, and is positioned in the sump 164 to apply an adjustable force against the metering roller surface 158 by selective application of the force with a spring 174 affixed to both a bearing plate 176 (schematically illustrated) and the plate 170. The surface of the metering plate is relatively hard and may be made of metal or elastomeric material.

The spring force urges the metering plate 170 against the metering roller surface 158 and this force may be increased or decreased to vary the contact pressure between the roller surface 158 and the plate surface 172. The second (metering) stage 124 is positioned along a translatable axis in a direction indicated by arrows 182 to selectively engage the surface 158 of sump roller 156 against the first (transfer) stage roller surface 44 of FIG. 2 in a manner as described above for the second (metering) stage 24. With the metering roller surface 158 being driven by the motor 168, rollers 156 and 34 are allowed to slip with respect to each other. The contact forces between the surfaces 44 and 158 is substantially less than what is required to prevent slippage between the surfaces, but is sufficient contact to assure sufficient transfer of release agent from the surface 158 to the surface 44.

Referring back to FIG. 2, the invention enables a more uniform application of release agent to the fusing surface. For example, an upper set of rollers, e.g., the first (transfer) stage 22, can move into and out of engagement with the fuser roller 26 while a lower (metering) stage, e.g., roller 56 in contact with release fluid in the sump 64, can be moved into rolling contact with an upper roller, e.g., roller 34. Accordingly, the metering stage may set the amount of release fluid made available to the fuser roller, while the transfer rollers assure a more uniform application of the release fluid to the fuser roller. The amount of release agent taken up by the metering stage is proportional to the speed at which the roller is turned. The faster the lower roller surface (e.g., surface 58) moves, the greater the amount of release fluid delivered to the upper stage.

In lieu of the motor 68 shown to drive the metering roller 56 (FIG. 2), it is possible to couple the roller 56 and the fuser roller 26 to a common drive incorporating a variable speed adjustment mechanism for the roller 56 as well as mechanisms for selective engagement of each roller to the motor. This embodiment is not shown, but implementing a variable speed drive from a fixed drive is conventional.

Figure 4:
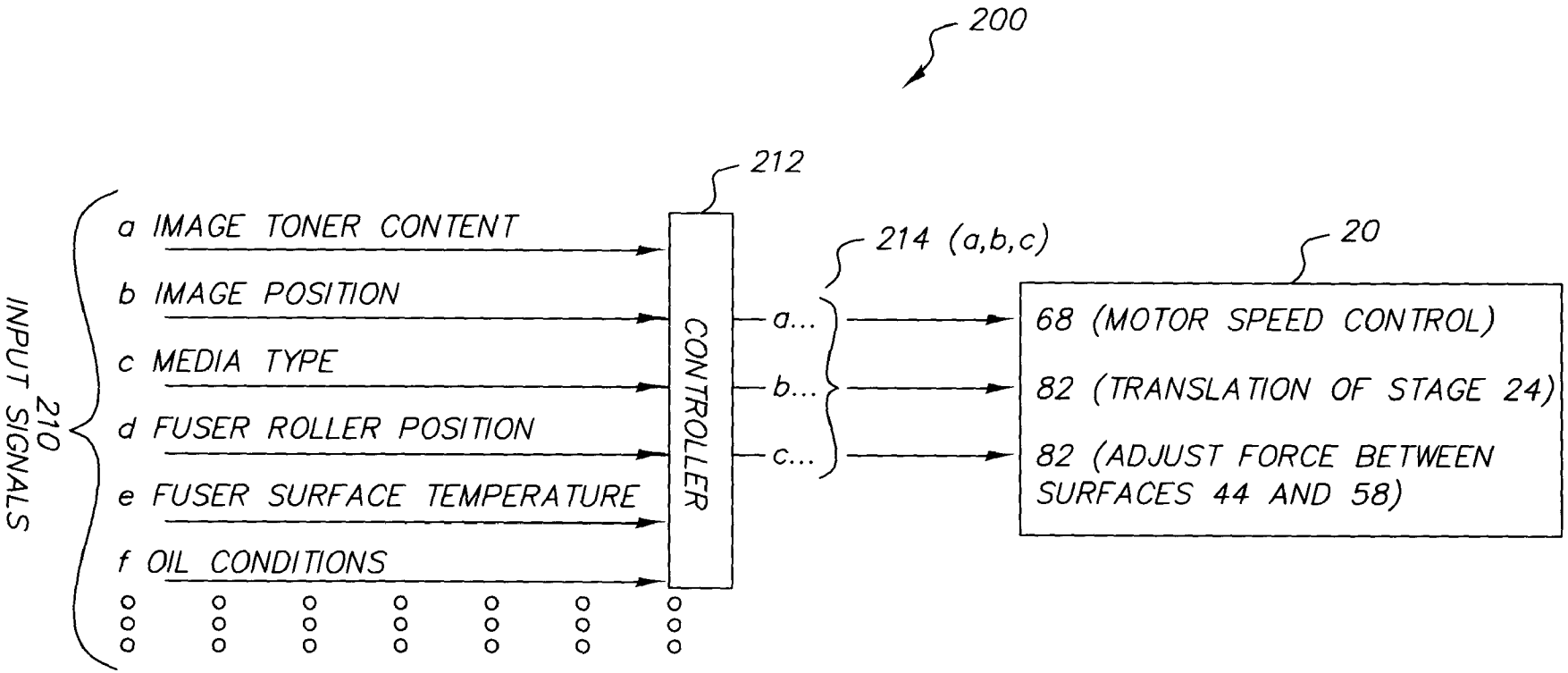
FIG. 4 illustrates a system for varying the amount of release agent made available to a fuser roller.

With the system of this invention capable of varying the amount of release agent made available to the fuser roller, it is now possible to provide greater control over application of the release agent as a function of parameters that affect image quality. FIG. 4 illustrates such a control system 200 which varies the amount of release agent made available to the fuser roller.

A series of data lines 210 (a, b, c, d, e, f . . . ) provide user input information or sensed data to a digital controller 212. The controller includes a microprocessor or a digital signal processor. As indicated in the figure, input data includes information indicative of the following: line 210(*a*)—image toner content (for example as a function of position on the substrate 30); line 210(*b*)—image position, based in part on the substrate position relative to a position along the fuser roller surface 28; line 210(*c*)—media type, e.g., paper, transparency, size, etc.; 210(*d*)—fuser roller position; 210(*e*)—temperature at the fuser roller surface; and 210(*f*)—release agent conditions, e.g., temperature or viscosity of the release agent fluid. Values of additional reproduction parameters may be input along other of the lines 210 as well.

With this input information, it is possible to vary the amount of release fluid based on: (a) the rotational position of the fuser surface 28 in relation to the position of an image on the substrate 30; and (b) the amount of toner along portions of the image passing against the fuser surface 28. With this information, the controller 212 can provide control signals 214 to the release agent system 20 to improve the quality and efficiency of image reproduction. The amount of release agent transferred to portions of the fuser surface is a function of the amount of toner coming into contact with each portion of the fuser surface 28. That is, the control signal 214(*a*) is used to adjust the speed of the motor 68 and thereby control the amount of release agent, e.g., more fluid for highly toned images and less fluid for lightly toned images.

For example, if an upper portion of a black and white image is mostly dark and a lower portion of the image is mostly white, the system 200 applies a relatively high motor speed to supply more release fluid to the portion of the fuser surface 28 which comes into contact with the mostly dark portion of the image and subsequently applies a relatively low motor speed to supply less release fluid to the portion of the fuser surface 28 which comes into contact with the mostly white portion of the image. To assure effective motor control, the motor speed may be monitored through another of the data lines 210 to establish a feedback control system. With this arrangement, variation in release agent transfer to the fuser by the processor system may be most assuredly synchronized with movement of the substrate along the fuser.

More generally, with the inputs 210, the controller 212 can vary and control the speed of the motor 68 that drives the roller 56, the control signal sent on line 214(*a*); and can translate the lower, second (metering) stage 24 in or out of engagement with the first (transfer) stage roller 34 the control signal sent on line 214(*b*), e.g., to a solenoid switch. By sensing the relative speeds of the roller surfaces 44 and 58 (e.g., additional input data which may be provided on lines 210), it can be determined whether the associated contact force is at an appropriate low level to allow slippage between the surfaces during rotation, yet at a sufficient level to assure a desirable transfer of release fluid from surface to surface. When this is not the case, a control signal is sent along line 214(*c*) to adjust the force between the roller surfaces 44 and 58.

Figure 5:
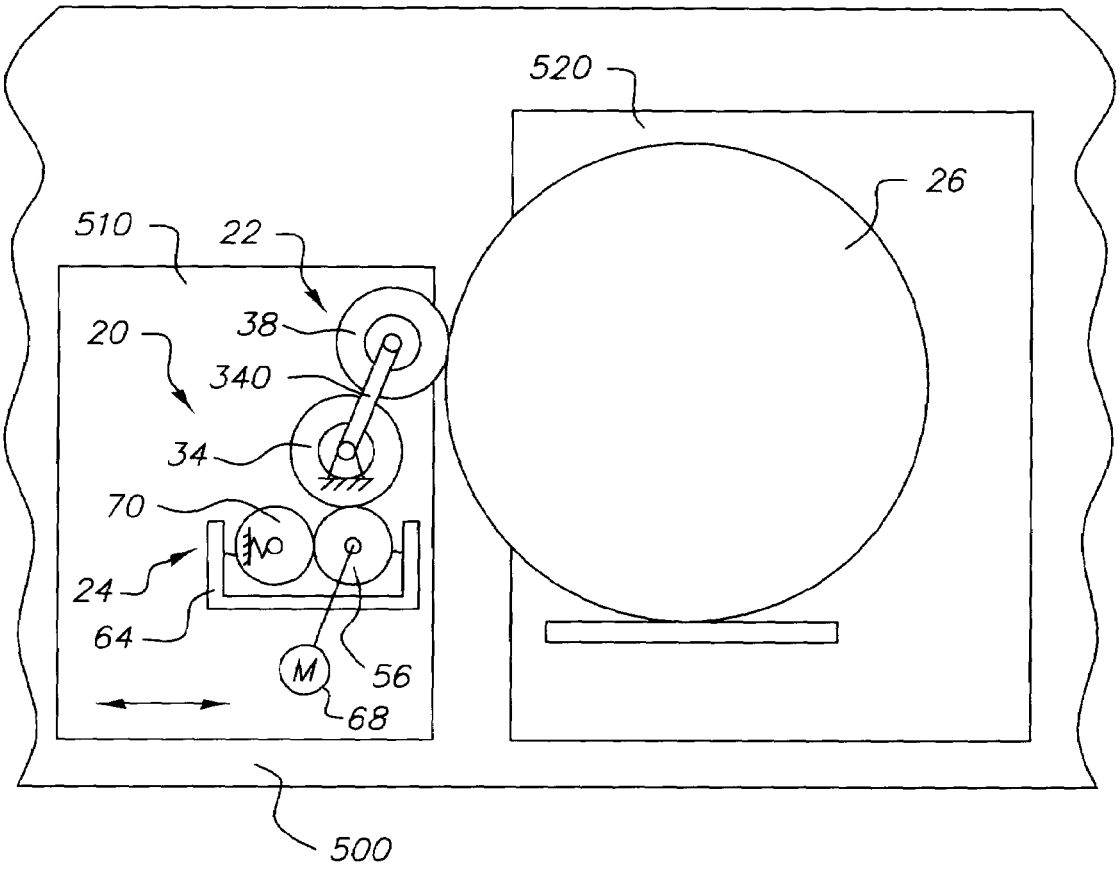
FIG. 5 illustrates a system where the release agent management stages are mounted independently from the fuser roller.

Another embodiment of the invention is illustrated in FIG. 5. There the first (transfer) and second (metering) stages are shown mounted on a sub-frame 510. The fuser roller 26 is mounted on a second, separate sub-frame 520. The two sub-frames are mounted on a machine frame 500 that supports the electrographic machine. The sub-frames 510, 520 are moveable with respect to each other and can be separately accessed by a user for operation, maintenance or repair. In operation, the two stages of the release management system 20 may be disengaged from the fuser surface by moving the sub-frame 510 away from sub-frame 520. As an alternative, the link 340 and the transfer roller 34 can rotate around the center of the transfer roller 38 to engage and disengage the transfer roller 38 with the metering roller 56. The embodiment shown in FIG. 5 depicts stages 22, 24 of FIG. 2, but a second (metering) stage 124 comparable to second (metering) stage (FIG. 3) could be substituted for stage 24.

In summary, with a fuser release agent system including a sump for containing a release fluid for transfer to the fuser, and a stage configured to transfer a variable amount of release fluid from the sump to the fuser, a processor system varies the amount of fluid transferred from the sump to the fuser in response to signals indicative of a change in one or more image reproduction parameters.

The invention has been described in detail with particular reference to certain preferred embodiments thereof, but it will be understood that variations and modifications can be effected within the spirit and scope of the invention.

PARTS LIST

20 Release agent system
22 First (transfer) stage
24 Second (metering) stage
26 Fuser Roller
28 Fuser Roller surface
30 Substrate
34 Conformable transfer roller with elastomeric surface
36 Axis
38 Conformable transfer roller with elastomeric surface
40 link
42 Axis
44 Roller 34 surface
48 Roller 38 surface
56 Metering roller
58 Metering roller 56 surface
62 Axis
64 Sump
68 Drive motor
70 Metering roller
72 Metering roller 70 surface
74 Spring
78 Axis
79 Plate
80 Release agent
82 Arrow indicating direction of movement of translatable axis
124 Second (metering) stage
156 Metering roller
158 Metering roller 156 surface

168 Drive motor
170 Metering plate
172 Metering plate surface
174 Spring
176 Plate
182 Arrow indicating movement of translatable Axis
200 Control system
210 (a) Image toner content data line
(b) Image position data line
(c) Media type data line
(d) Fuser roller position data line
(e) Fuser surface temperature data line
(f) Release agent conditions data line
212 Digital controller
214 Control signals
(a) Motor 68 speed control signal
(b) Control signal
(c) Roller Surfaces 44 and 58 adjust force control signal
340 Link
500 Machine frame
510 Sub-frame
520 Sub-frame

What is claimed is:

1. A fuser release agent dispensing system for a fuser device of a reproduction apparatus for toner image production on a substrate, comprising:

a sump containing a supply of release agent; a release agent transfer stage for transferring release agent to a fuser device and having a first transfer roller with a surface rotatable about an axis, a second transfer roller positionable for contact with said first transfer roller while being simultaneously selectively positionable relative to said fuser device to simultaneously rotate with said fuser device and couple the rotation of said fuser device to said first transfer roller; and a release agent metering stage operatively associated with said transfer stage for controlling the amount of release agent received by said transfer stage, said metering stage having a metering roller with a surface for removing release agent from said sump, and a translational assembly configured to move said metering roller surface into and out of contact with the first transfer roller surface.

2. The system of claim 1, wherein said second transfer roller includes an axis rotatable about the axis of said first transfer roller for selective engagement of said second transfer roller with said fuser device.

3. The system of claim 1, further including a drive for rotating said metering roller.

4. The system of claim 3, wherein said drive provides rotational movement of said metering roller surface while in contact with the first transfer roller surface to withdraw release agent from said sump and along said metering roller to said first transfer roller surface.

5. The system of claim 1, wherein said translational assembly is capable of imparting sufficient contact between said first transfer roller and said metering roller surface to transfer release agent from said metering roller surface to said first transfer roller surface while said first transfer roller surface moves at a speed which is primarily a function of the rotational speed of said second transfer roller and independent of the speed of said metering roller surface.

6. The system of claim 1, wherein said metering stage further includes a metering surface in contact with said metering roller surface according to a contact force to control the amount of release agent withdrawn from said sump and received by said first transfer roller from said metering roller.

7. The system of claim 6, wherein said metering surface in contact with said metering roller surface is the surface of a plate positioned in said sump.

8. The system of claim 1, wherein said metering roller has a hard surface and said first and second transfer rollers have soft surfaces.

9. A fuser and a release agent dispensing system for such fuser for image production, comprising:

a rotatable fuser roller;

a release agent transfer stage including a first transfer roller having a surface rotatable about a fixed axis, a second transfer roller positionable for contact with said first transfer roller and positionable against said fuser roller to engage said fuser roller and thereby rotate said first and second transfer rollers with said fuser roller, said first and second transfer rollers having relatively soft, conformable surfaces to form a nip and to distribute release agent to said fuser roller; and a release agent metering stage including a sump for holding a release agent, a metering roller and an additional metering roller, each metering roller at least partially immersed in said sump and engaged with each other to form a nip therebetween, said metering rollers having relatively hard surfaces compared to said surfaces of each first and second transfer rollers for precisely controlling an amount of release agent passing through the nip of said metering rollers, one of said metering rollers selectively engaging the second transfer roller in said transfer stage for transferring a controlled amount of release agent to said second transfer roller.

10. An image reproduction system comprising:

a fuser roller having a surface for affixing toner to a substrate;

a fuser release agent system including a sump for holding release agent for transfer to said fuser roller, a metering stage to generate a metered amount of release agent, and a transfer stage to transfer said metered amounts of release agent from said metering stage to said fuser roller; and a controller coupled to the fuser release agent system to control the amount of release agent transferred from the sump to the fuser roller in response to signals indicative of a change in one or more image reproduction parameters, wherein said image reproduction parameters include one or more variables taken from the group consisting of image density, media type, fuser temperature and release agent viscosity.

11. The system of claim 10, wherein a variation in release agent transfer to said fuser by said controller is synchronized with movement of the substrate along said fuser.

12. The system of claim 10, wherein said controller varies the amount of release agent transferred to portions of the fuser surface as a function of the amount of toner coming into contact with each such fuser surface portion.

13. The system of claim 10, wherein said metering stage has a metering roller and a metering surface for removing metered amounts of release agent from said sump, and said transfer stage includes a pair of transfer rollers engaged with each other, one transfer roller engaged with said metering roller and the other of said transfer rollers engaged with said fuser roller for transferring release agent from said metering stage to said fuser roller, wherein said metering stage has a variable rotational speed under control of said controller and independent from said fuser roller speed to control the amount of release agent transferred to said fuser roller as a function of the speed of said first transfer roller.

14. A method for controlling application of release agent to a fuser roller, comprising the steps of:

transferring a controlled amount of release agent from a sump to the fuser roller; and controlling a variation in the amount of release agent transferred from the sump to the fuser roller in response to signals indicative of a change in one or more image reproduction parameters, wherein the step of controlling the variation in the amount of release agent transferred to the fuser roller is responsive to a change in one or more reproduction parameters taken from the group consisting of image density, media type, fuser temperature and release agent viscosity.

15. The method of claim 14, wherein the step of controlling the variation in the amount of release agent transferred to the fuser roller includes varying the amount of release agent transferred to portions of the fuser roller as a function of the amount of toner coming into contact with each such fuser roller surface portion.

* * * * *